United States Patent [19]

Wagner et al.

[11] 4,359,135

[45] Nov. 16, 1982

[54] MUFFLER ASSEMBLY

[75] Inventors: Wayne M. Wagner, Apple Valley; David E. Winnes, Bloomington, both of Minn.

[73] Assignee: Donaldson Company, Inc., Minneapolis, Minn.

[21] Appl. No.: 142,663

[22] Filed: Apr. 21, 1980

Related U.S. Application Data

[63] Continuation-in-part of Ser. No. 71,542, Aug. 31, 1979, Pat. No. 4,267,899.

[51] Int. Cl.[3] ..... F01N 1/02; F01N 1/08

[52] U.S. Cl. ..... 181/266; 181/272; 181/273

[58] Field of Search ..... 181/264–266, 181/268, 272, 273, 275, 276, 253, 259, 296, 249

[56] References Cited

U.S. PATENT DOCUMENTS 3,419,892 12/1968 Wagner et al. ..... 181/259 X
3,672,464 6/1972 Rowley et al. ..... 181/253
4,111,278 9/1978 Bergman ..... 181/249
4,111,279 9/1978 Sterrett ..... 181/264
4,192,401 3/1980 Deaver et al. ..... 181/272 X

*Primary Examiner*—Benjamin R. Fuller
*Attorney, Agent, or Firm*—Merchant, Gould, Smith, Edell, Welter & Schmidt

[57] ABSTRACT

A muffler comprising a housing (12) having end caps (16, 18) and partitions (32, 38, 42) which divide it into first and second expansion chambers (40, 44), a flow chamber (36), and a resonator chamber (34). An inlet tube (20) passes through end cap (16) and partitions (38) and (32) to open into chamber (34): it has perforations (58) and (62) which afford communication with chambers (40) and (36) respectively. An outlet tube (24) passes through end cap (18) and partitions (42) and (32) to open into chamber (36): it has perforations (70) which afford communication with chamber (44), and includes anti-whistle beads (72). A conversion-divergent nozzle (80) is located in tube (22) at its end opening into chamber (36). Apertures (190) are provided to afford limited flow of gas through chamber (34) from tube (20) to chamber (36).

11 Claims, 6 Drawing Figures

MUFFLER ASSEMBLY

This case is a continuation-in-part of our co-pending application, Ser. No. 71, 542, filed Aug. 31, 1979, U.S. Pat. No. 4,267,899, and assigned to the assignee of the present application.

TECHNICAL FIELD

The present invention relates to mufflers for use with machines of various types, such as internal combustion engines. More specifically, the present invention relates to a muffler for attenuating noise generated by an engine to which the muffler is connected and carried to the muffler with exhaust gas from the engine.

BACKGROUND OF THE PRIOR ART

Numerous types of sound attenuating mufflers are known in the prior art. One type of muffler is a "straight through" muffler. A typical example of such a muffler is illustrated in U.S. Pat. No. 3,672,464 to Rowley et al. A convergent-divergent nozzle member is supported within a perforated outlet tube of the muffler and serves to attenuate sound generated by an internal combustion engine to which the muffler is attached.

Another type of prior art muffler is a combination muffler and air ejector unit. In such a muffler, two inlets to the muffler assembly are utilized. A first inlet communicates engine exhaust gases to the muffler and a second inlet communicates dirty air scavenged from an air cleaner during engine operation. Such a combined muffler and air ejector unit is illustrated in U.S. Pat. No. 3,419,892 to Wayne M. Wagner et al.

U.S. Pat. No. 4,111,279 to Sterrett discloses a muffler divided into a Helmholtz resonator chamber and a flow chamber. An inlet tube passes through the flow chamber and has an open end within the resonator chamber. Lateral perforations or louvres through the first tube provide communication between the interior of the first tube and the flow chamber. A laterally imperforate outlet tube extends through the resonator chamber and has an open end disposed within the flow chamber. Applicants have found that the use of a two-chamber system similar to the muffler system disclosed in the Sterrett patent, when constructed of a practical size, does not exhibit sufficient sound attenuating properties for modern applications. The need for mufflers with high noise attenuating capabilities has increased in recent years because of increasingly stringent governmental noise pollution regulations. For example, recent EPA regulation changes have lowered permissible sound levels on portable air compressors, which are commonly used in construction and road working applications.

SUMMARY OF THE INVENTION

The present invention is directed to a muffler providing a sound attenuating path for the flow of the output gas of an engine connected thereto, to reduce the noise level of gas discharged therefrom. The muffler includes a housing, extending along a longitudinal axis between first and second end walls, which defines an interior space and has an inlet at one end and an outlet at the other end. Separation means divides the interior space into a resonator chamber, a flow chamber, and inlet and outlet expansion chambers. An inlet tube connected to the inlet passes through the inlet expansion chamber and the flow chamber, and has an open end disposed in the resonator chamber and a plurality of transverse apertures or flow holes for providing fluid communication between the inlet and the flow chamber. An outlet tube connected to the outlet passes through the resonator chamber and the outlet expansion chamber and has an open end disposed within the flow chamber for guiding gas from the flow chamber to the outlet. The inlet and outlet tubes each having a plurality of transverse flow holes for providing communication with the respective attenuation chambers so that broad band sound attenuation can occur therein. The resonator chamber is branched from the flow path from inlet to outlet of the muffler.

In a preferred embodiment, the separation means includes three transverse baffle plates or partitions spaced along the axis of the housing between the end walls. The first partition forms a dividing wall between the resonator chamber on one side and the flow chamber on the other side. The second partition is located between the first partition and the first end wall. The flow chamber is formed in the space between the first and second partitions, and the inlet expansion chamber is formed between the second partition and the first end wall. A third partition is located between the first partition and the second end wall. The resonator chamber is formed between the first and third partitions, and the outlet expansion chamber is formed between the third partition and the second end wall. The inlet tube passes through aligned holes in the first end wall and second and first partitions, and the outlet tube passes through aligned holes in the second end wall and the third and first partitions. In this manner, the inlet and outlet conduits are supported in transversely spaced generally parallel relationship. Exhaust gas flowing through the muffler passes from the inlet tube through the flow holes into the flow chamber, and thereafter passes out of the muffler through the outlet tube. Sound attenuation of noise being carried with the exhaust gas occurs at the two broad band attenuation chambers. A convergent-divergent nozzle member may be supported within the outlet tube to provide further broad band sound attenuation. Narrow band sound attenuation occurs at the resonator chamber.

Although resonator chambers are customarily arranged to prevent flow of gas therein, we have found that the efficacy of the resonator chamber as well as the through-put of the muffler are augmented if a limited flow of gas is caused to take place through the resonator chamber, and accordingly we may provide means to accomplish this, preferably in the form of apertures in the first baffle plate enabling direct communication between the resonator chamber and the flow chamber.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DETAILED DESCRIPTION OF THE INVENTION

Figures 1, 2, 3, 4, 5, 6:
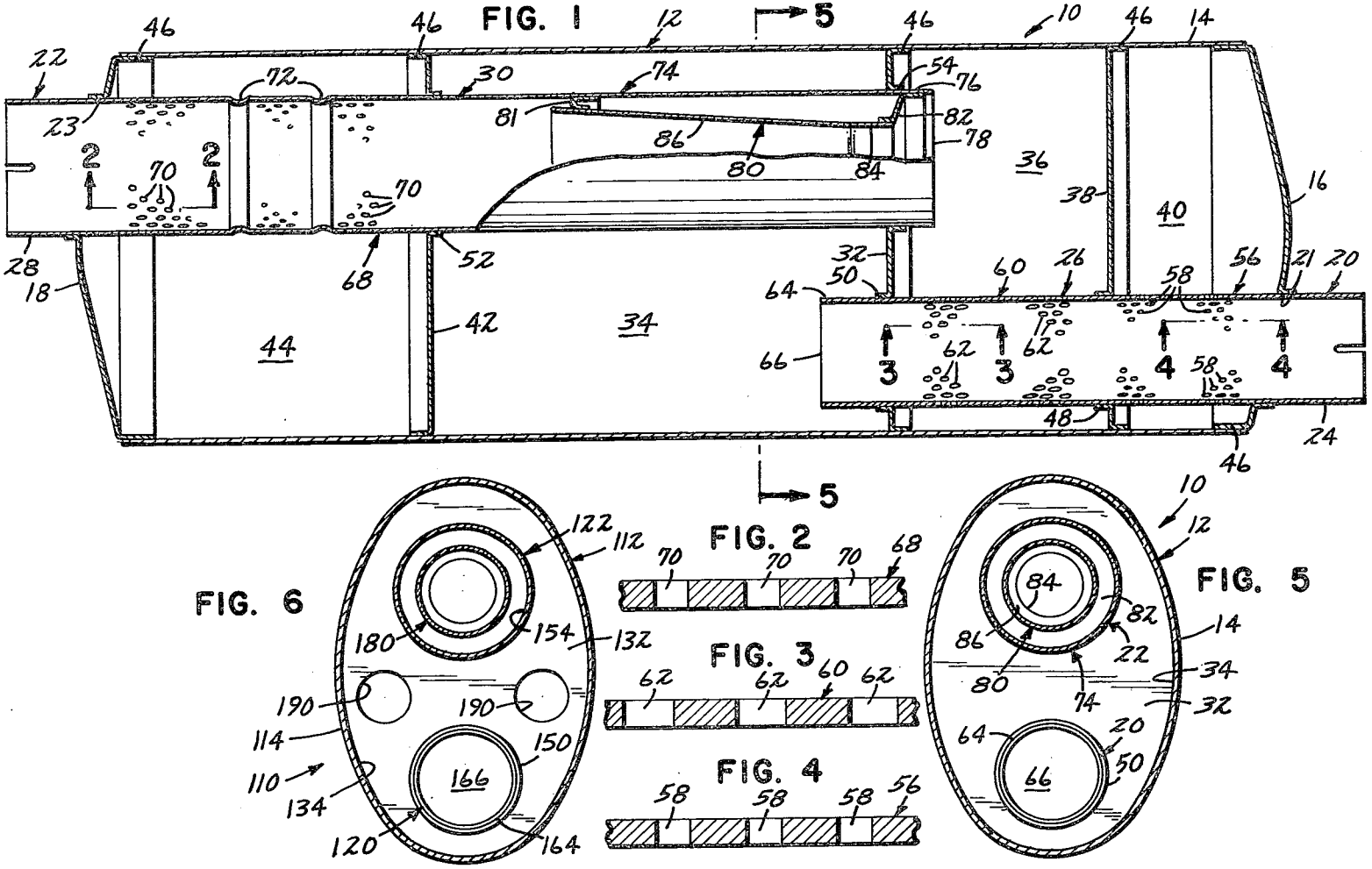
FIG. 1 is an axial sectional view, partially broken away, illustrating a muffler in accordance with the present invention.
FIG. 2 is a sectional view on an enlarged scale taken generally along line 2—2 of FIG. 1.
FIG. 3 is a sectional view on an enlarged scale taken generally along line 3—3 of FIG. 1.
FIG. 4 is a sectional view on an enlarged scale taken generally along line 4—4 of FIG. 1.
FIG. 5 is a transverse sectional view taken along the line 5—5 of FIG. 1.
FIG. 6 is a view similar to FIG. 5, showing a modified structure.

Referring to the drawings in detail wherein like numerals indicate like elements, there is shown in FIG. 1 a muffler in accordance with the present invention, designated generally by the reference numeral 10. Muffler 10 includes a housing 12 which is comprised of a boundary wall 14 extending longitudinally along an axis, a first end wall 16 secured to a first end of the wall 14, and a second end wall 18 secured to an opposite longitudinal end of the wall 14. Wall 14 is shown as curvilinear in section and may be either round or oval. However, a rectilinear configuration, wherein a plurality of flat longitudinally extending surfaces are interconnected, could also be used.

An inlet tube 20 extends through an inlet port or hole 21 in end wall 16 longitudinally into housing 12. An outlet tube 22 extends through an outlet port or hole 23 in the end wall 18 longitudinally into housing 12. Inlet tube 20 has a first section or inlet 24 which is disposed outside housing 12 and a second section 26 which is disposed within the interior space bounded by the housing. Similarly, outlet tube 22 has a first section or outlet 28 disposed outside housing 12 and a second section 30 disposed within the interior space bounded by the housing.

A first partition or baffle plate 32 is secured in housing 12 and forms a dividing wall between a narrow band resonator chamber 34 on one side and a flow chamber 36 on the other side. A second partition 38 is secured in housing 12 between partition 32 and end wall 16. A flow chamber 36 is formed between the first and second partitions, and an inlet expansion chamber 40 or broad band sound attenuator is formed between partition 38 and end wall 16. A third partition 42 is secured in housing 12 at a location between first partition 32 and end wall 18. The resonator chamber 34 is thus formed between the first and third partitions 32 and 42, and an outlet expansion chamber 44 or broad band sound attenuator is thus formed between partition 42 and end wall 18.

End walls 16, 18 and partitions 32, 38 and 42 are each preferably made of a single integral piece of material, and each has a mounting flange or lip 46 extending about its periphery. The walls and partitions are all preferably made of heavy-duty metal and the flanges 46 are fixed to the interior surface of the wall 14 as by spot welding. The second section 26 of inlet tube 22 extends through a hole 48 formed through partition 38 and a hole 50 formed through partition 32, holes 48 and 50 and partition 21 being in alignment. The second section 30 of tube 22 extends through a hole 52 formed through partition 42 and through a second hole 54 formed through partition 32, holes 52, 54 and port 23 being in alignment. In this manner, the inlet tube 20 and the outlet tube 22 are held in a laterally spaced relationship, generally parallel to the axis of the housing.

A portion 56 of inlet tube 20 is disposed within inlet expansion chamber 40. Portion 56 has a plurality of perforations or holes 58 formed through it. Another portion 60 of inlet tube 20 is disposed within flow chamber 36 and has a plurality of perforations or holes 62 formed through it. A further portion 64 of tube 20 is disposed within resonator chamber 34 and has an open end 66. Except for the opening 66, the resonator chamber in this embodiment of the invention is completely sealed or enclosed and, hence, acts as a Helmholtz resonator for narrow band sound attenuation. Outlet tube 22 has a portion 68 which is disposed in outlet expansion chamber 44 and has a plurality of perforations or holes 70 formed through it as well as a pair of antiwhistle beads or annular indentations 72. Tube 22 has another portion 74 which is disposed within resonator chamber 34. A further portion 76 of tube 22 is disposed within flow chamber 36 and has an open end 78 therein. A convergent-divergent nozzle member 80 is supported within portion 74 of tube 22, and serves as a further broad band noise attenutating means. An annular support member 81 holds the outlet end of nozzle member 80 in outlet tube 22. Nozzle 80 has an abruptly tapering converging inlet portion 82, a throat 84, and a diverging portion 86. For a fuller discussion of the structure and function of nozzle member 80, reference is made to U.S. Pat. No. 3,672,464, the disclosure of which is incorporated herein.

As is best seen in FIGS. 2–4, the size of the holes 58 and 70 is approximately the same, while the holes 62 are larger than the holes 58 and 70. To attain satisfactory sound attenuation, the holes 58 open approximately 5 to 30 percent of the surface area of portion 56 to chamber 40, and the holes 70 open approximately 5 to 30 percent of the surface area of portion 68 to chamber 44. Also, approximately 5 to 30 percent of the surface area of portion 60 is open to the flow chamber 36 by means of the holes 62. In an exemplary muffler 10, the inlet tube 20 may have a diameter of four or five inches and the outlet tube 22 may have a diameter of five inches. Within such a muffler 10, the holes 58, 70 would preferably be $\frac{1}{8}$ inch in diameter and the holes 62 would be approximately 3/16 inch in diameter.

Muffler 10 operates in the following manner. Exhaust gases having a sonic component of energy enter the muffler through inlet tube 20. The flow path of gases is through the interior of inlet tube 20, through the perforations or holes 62 and into flow chamber 36. Thereafter, the exhaust gases flow into outlet tube 22, through nozzle member 80, and out of the muffler. Resonator chamber 34 is branched from this flow path. During the passage of the exhaust gases through the muffler, sound attenuation occurs in several different areas of the muffler. The perforations or holes 58 provide communication between the interior of the inlet tube 20 and inlet chamber 40, which serves as a broad band attenuator to attenuate sound waves over a relatively broad frequency band. Chamber 34 serves as a Helmholtz resonator chamber and is tuned to attenuate sound waves primarily at a selected frequency, typically a low frequency. The selected frequency is generally a strong or objectionable frequency produced by the engine or machine to which the muffler is attached. Broad band attenuation of sound waves is also accomplished by the passage of the gas and sound waves through nozzle member 80. Finally, broad band sound attenuation also occurs at outlet chamber 44 which is placed in communication with the interior of outlet tube 22 by the perforations or holes 70.

FIG. 6 is a transverse section of a second embodiment of the invention, which is generally like that just described, so that like elements are given the same reference numerals increased by one hundred. In this embodiment partition 132 is provided with further apertures 190 to act as passages for enabling a limited flow of gas through the resonator chamber. The number or pattern of these holes has not been found to be cricital. It has been found that provision of passages having a total area from 25 to 50 percent of the area of opening 166 considerably increases the throughput of the muffler, and that these openings not only do not diminish the efficacy of the resonator chamber, but actually improve it. An explanation for this unexpected result is not presently available.

In this embodiment of the invention the broad band and narrow band sound attenuation occurs as described above: the gas flow path described above is also present, but is augmented by a further flow into the resonator chamber at 166, through the chamber, and out into the flow chamber through apertures 190. While this added flow has been enabled by apertures in partition 132, it could also be accomplished in other ways, as by providing apertures in the third partition, FIG. 1, or in the portion of the outlet tube between the nozzle member and the third partition.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In a muffler, for the output gas of a machine, in combination:

a housing;

separation means comprising a plurality of partitions dividing said housing into a first expansion chamber, a flow chamber, a resonator chamber, and a second expansion chamber;

inlet means comprising a first tube, passing in turn through said first expansion chamber, a partition, said flow chamber, a partition between said flow chamber and said resonator chamber, and opening into said resonator chamber, said first tube being laterally perforated at a first site to enable communication with said first expansion chamber, and at a second site to enable restricted flow of gas into said flow chamber; and outlet means comprising a second tube, opening from said flow chamber and passing through said partition between said flow chamber and said resonator chamber, said resonator chamber, said second expansion chamber and a partition therebetween, said tube being laterally perforated at a first site to enable communication with said second expansion chamber;

said partition between said flow chamber and said resonator chamber being apertured to enable limited flow of said gas through said resonator chamber.

2. A muffler according to claim 1 and a nozzle attenuator in said second tube at a second site.

3. A muffler according to claim 1 in which the ratio of the area of said opening of said inlet means into said resonator chamber to the apertured area in said partition between said flow chamber and said resonator chamber is between 2-to-1 and 4-to-1.

4. A muffler according to claim 1 in which the ratio of the area of said opening of said inlet means into said resonator chamber to the apertured area in said partition between said flow chamber and said resonator chamber is substantially 2-to-1.

5. In a muffler:

a housing having a longitudinal axis and first and second end caps;

a plurality of partitions dividing said housing into a first expansion chamber adjacent said first end cap, a flow chamber adjacent said first expansion chamber, a resonator chamber adjacent said flow chamber, and a second expansion chamber between said resonator chamber and said second end cap;

inlet means comprising a first tubular member extending through said first end cap and two of said partitions to project and open into said resonator chamber, said inlet means being laterally apertured at a first site to give communication to said first expansion chamber and at a second site to enable restricted gas flow into said flow chamber; and outlet means comprising a second tubular member extending through said second end cap and two of said partitions to open into said flow chamber, said outlet means being laterally apertured at a first site to give communication to said second expansion chamber;

said partition between said flow chamber and said resonator chamber being apertured to enable limited flow of gas from said inlet means through said resonator chamber into said flow chamber, and the ratio of the area of the opening of said inlet means into said resonator chamber to the apertured area of said partition being between 2-to-1 and 4-to-1.

6. A muffler according to claim 5 in which said ratio is substantially 2-to-1.

7. A muffler according to claim 5 and a nozzle attenuator in said second tubular member between said first site and said flow chamber.

8. A muffler for reducing the noise level of gases passing therethrough, comprising:

a housing defining an interior space and having an inlet and an outlet;

an inlet conduit in fluid communication with said inlet and extending a distance within said interior space for guiding gases into the muffler;

an outlet conduit in fluid communication with said outlet and extending a distance within said interior space for guiding gases out of the muffler;

partition means for dividing said interior space into a resonator chamber, a flow chamber, and at least one expansion chamber;

said inlet conduit having an open end disposed within said resonator chamber and a plurality of flow holes through it for providing fluid communication between said inlet and said flow chamber;

said outlet conduit having an open end disposed within said flow chamber for guiding gas from said flow chamber to said outlet;

means enabling limited flow of gas through said resonator chamber; and at least one of said inlet and outlet conduits having a plurality of attenuation holes through it for providing fluid communication to said at least one expansion chamber so that broad band sound attenuation can occur therein.

9. A muffler for reducing the noise level of gases passing therethrough, comprising:

(a) a housing defining an interior space and having an inlet and an outlet;

(b) means in said housing for dividing said interior space into a resonator chamber, a flow chamber, and at least one expansion chamber;

(c) means defining a gas flow path between said inlet and said outlet, comprising:

(i) inlet conduit means in fluid communication with said inlet and extending a distance within said interior space for guiding gases into the muffler;

(ii) an outlet conduit in fluid communication with said outlet and extending a distance within said interior space for guiding gases out of the muffler;

(iii) said inlet conduit means having an open end disposed within said resonator chamber and having means providing fluid communication between said inlet and said flow chamber;

(iv) said outlet conduit having an opening disposed within said flow chamber for guiding gas from said flow chamber to said outlet;

(d) means including aperture means between said resonator chamber and said gas flow path enabling limited flow of gas through said resonator chamber, the ratio of the area of the open end of said inlet means into said resonator chamber to the aperture means being between 2-to-1 and 4-to-1; and (e) at least one of said inlet and outlet conduits having a plurality of attenuation holes through it for providing fluid communication to said at least one expansion chamber so that broad band sound attenuation can occur therein.

10. A muffler according to claim 9 in which said ratio is substantially 2-to-1.

11. A muffler according to claim 9 and a nozzle attenuator in said outlet conduit between said outlet and said flow chamber.

* * * * *